United States Patent [19]

Nuttall

[11] 4,020,853

[45] May 3, 1977

[54] SMOKING PIPE

[76] Inventor: Richard T. Nuttall, 15088 Sandrock Drive, Lake Hughes, Calif. 93532

[22] Filed: Oct. 2, 1975

[21] Appl. No.: 619,015

[52] U.S. Cl. ..... 131/195; 131/196

[51] Int. Cl.[2] ..... A24F 1/22; A24F 13/04

[58] Field of Search ..... 131/196, 195, 199, 226

[56] References Cited

UNITED STATES PATENTS

| | | | |
|---|---|---|---|
| 223,630 | 1/1880 | Bacon | 131/196 |
| 647,740 | 4/1900 | Beatty | 131/196 |
| 682,470 | 9/1901 | Kennefick | 131/196 X |
| 3,422,821 | 1/1969 | Calkins | 131/195 |
| 3,529,604 | 9/1970 | Neset | 131/195 |

FOREIGN PATENTS OR APPLICATIONS

| | | | |
|---|---|---|---|
| 58,255 | 1/1891 | Germany | 131/195 |

*Primary Examiner*—Stephen C. Pellegrino

[57] ABSTRACT

A smoking pipe which can be made of an artistically ornamented ceramic such as porcelain wherein means is provided for maintaining the outer wall at a sufficiently low temperature to permit comfortable handling by the smoker, there being spaced inner and outer bowls with provision for air circulation inwardly and upwardly between the bowls by convection, the convection flow not only serving as a cooling medium but also as an upward draft to assist in keeping the tobacco in a burning condition even while the smoker is not drawing air and smoke through the inner bowl and stem of the pipe. The inner bowl is removably held and sealed about its bottom by a novel sealing arrangement with a yielding heat resistant material such as silicone rubber which also supports part of the smoke passage means leading to the stem.

13 Claims, 5 Drawing Figures

SMOKING PIPE

PRIOR ART

U.S. Pat. No. 3,791,390 issued Feb. 12, 1974 to Victor P. Hendricks discloses a smoking pipe with an inner wire mesh bowl or insert and air inlet openings in the wall of the main or outer bowl approximately mid way of the vertical height of the bowl. The structure is such that any convection flow which might exist would not be upward between the inner bowl or insert and the outer bowl but through the wall of the wire mesh insert and upwardly through the tobacco. This would not cool the outer or main bowl wall of a ceramic smoking pipe. Furthermore, the arrangement of the wire mesh insert and its relation to the smoke outlet passage 20 would cause short circuiting of the flow downward through the tobacco to the passage 20.

This invention relates to smoking pipes and has as one of its principle objects the provision of a pipe construction which will permit the pipe to be made from a ceramic material such as porcelain which can be provided in enduring colors and can also be otherwise artistically ornamented.

Pipes have been made for many years of clay which has been baked to render them relatively hard and resistant to breakage. These pipes have been made conventionally with a single wall of clay defining a hollow bowl. When smoked they become quite hot and uncomfortable to the touch.

Pipes have also been made of materials such as corncobs which are quite porous, being made up of many small hollow cells but such pipes are quite crude and unartistic in appearance, so that even though they are cool to the touch when being smoked, they are not very popular.

The present invention has as its general objects to provide a smoking pipe which can be made of a ceramic material such as colored and ornamented porcelain wherein means is provided for keeping the outer wall of the pipe cool enough for handling, and also to provide a pipe wherein the circulating air used to cool the pipe also serves to assist in maintaining the tobacco lighted between the times the user puffs on the mouthpiece.

Other objects and advantages of the invention will more fully appear from the following description in connection with the accompanying drawing.

DRAWING SUMMARY

Figure 1:
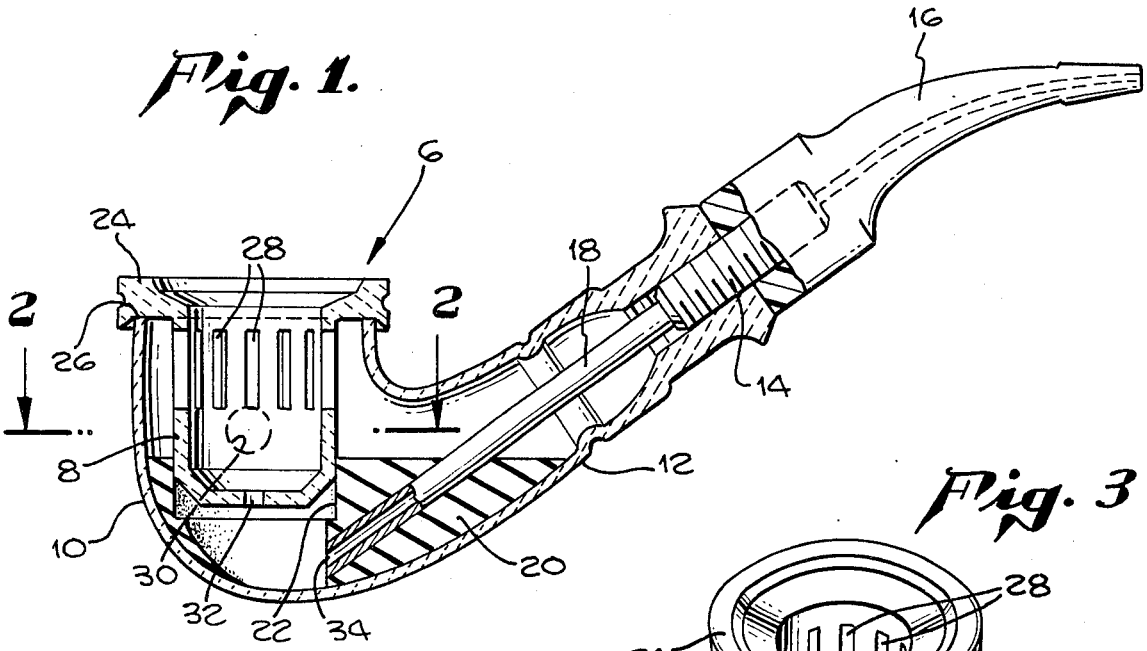
FIG. 1 is a side view partially in vertical section and partially in elevation of an embodiment of the invention.

There is shown a pipe body generally indicated at 6 with an inner bowl 8 and an outer wall 10. The outer wall has an extension 12 in the end of which is a threaded ferrule 14 to which is threaded a conventional stem 16. Extending downwardly from the ferrule 14 is a smoke tube 18 whose lower portion extends through and is embedded in a body of heat resistant resilient material 20 which preferably is silicone rubber. The body of rubber 20 has a recess 22 formed therein to frictionally receive the lower end portion of the inner bowl 8 and provide a seal about said inner bowl.

Figure 3:
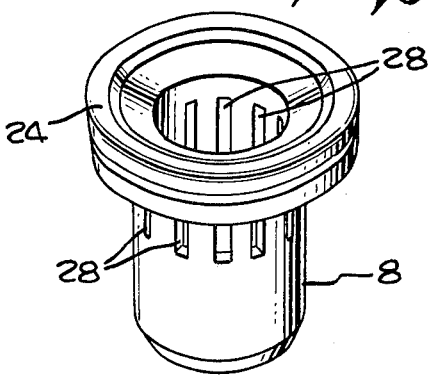
FIG. 3 is a perspective view of the removable inner bowl.
Figure 2:
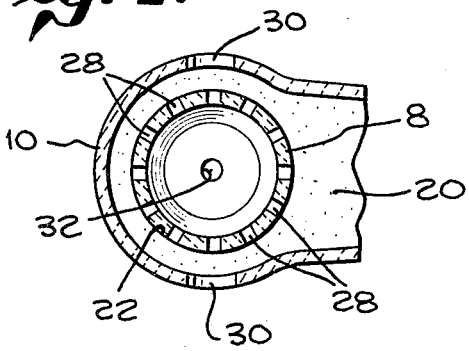
FIG. 2 is a section taken approximately on the line 2—2.

The inner bowl 8 is shown spaced inwardly from the outer wall 10. Said inner bowl 8 has at its upper end a laterally outwardly extending flange 24 which as shown best in FIG. 3 is free of any openings. Thus, there is a reasonably effective seal between the under side of the flange 24 and the upper edge 26 of the outer wall 10.

The upper circumferential portion of the inner bowl 8 is provided with vertical slots 28 which preferably extend from an upper portion adjacent the under side of the flange 24 to points downwardly adjacent the vertical medial portion of said bowl 8. The outer wall 10, preferably at opposite sides thereof, is provided with air inlet openings 30 which as shown in FIG. 1, are located preferably below the lower ends of the air inlets slots 28. The bottom of the bowl is closed as shown and centrally thereof is provided with a smoke outlet opening 32 which provides smoke flow to the conduit 34 in the interior of the smoke tube 18.

When the pipe is filled and lighted in a conventional manner it is preferred that the smoker place his thumb and forefinger over the two air inlet openings 30 in the outer wall 10. Then when the smoker puffs on the pipe air will be drawn downwardly through the open top of the inner bowl 8 and through the tobacco so that the tobacco will become ignited in the usual manner.

As the pipe is smoked the user leaves the air inlet openings 30 unobstructed. So that heat from the burning tobacco will cause a convection flow of air inwardly through said openings 30 and upwardly between the inner bowl 8 and the outer wall 10, through the upper ends of the vertical slots 28 and out through the open top portion of the bowl 8. This upward flow of air keeps the outer wall 10 quite cool and comfortable to the touch. For this reason it is possible to manufacture the outer wall of a ceramic such as porcelain and maintain it in sufficiently cool condition that it is comfortable to handle while the pipe is being smoked.

It is preferred that the inner bowl 8 be formed of a porous ceramic material so that it will soak up moisture incident to the smoking of pipes. Additionally, an absorbent element such as a rolled up pipe cleaner can be inserted in the bottom of the outer bowl beneath the inner bowl if desired. The absorbent element can be disposed of frequently and the porous inner bowl can be cleaned by soaking it in alcohol and rinsing in running water.

Figure 4:
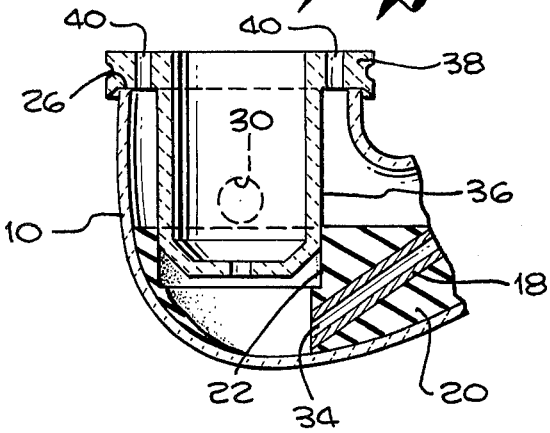
FIG. 4 is a vertical sectional view through a modified form of pipe and inner bowl arrangement.
Figure 5:
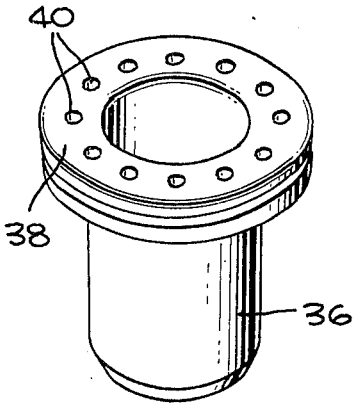
FIG. 5 is a perspective view of the inner bowl shown in FIG. 4.

FIGS. 4 and 5 show a different type of inner bowl 36. This bowl has an upper flange 38 provided with a plurality of symmetrically distributed air inlet openings 40. When tobacco is burned in the inner bowl 36 it will become heated and heat the air between it and the outer shell causing air to flow inwardly through the air inlet openings 30 thence upwardly between the inner bowl and outer shell and out through the openings 40.

From the foregoing it will be seen that I have provided a smoking pipe construction which is particularly suited for the use of a ceramic such as colored and ornamented porcelain as the material for the outer shell or outer bowl. While the convection flow is of course created by heating the air between the two bowl portions, the provision of a supply of air through the openings 30 at ambient temperatures keeps the outer shell in a quite cool condition which makes it comfortable to handle while smoking. Incidental to this feature is the maintenance of an upward air flow adjacent to burning tobacco to create an updraft and assist in keeping the tobacco in a burning condition during the periods when the smoker is not puffing on the pipe.

It will of course be understood that various changes can be made in the form, details, arrangement, and proportions of the various parts without departing from the spirit of the invention.

What is claimed is:

1. In a smoking pipe, a body having a bowl portion and a stem portion, the bowl portion having a side wall, an open top and a bottom, the side wall having air inlet means about the upper portion thereof, the lower portion of the side wall being substantially continuous and free of openings, said bowl bottom having a smoke outlet, an outer wall spaced about said side wall and bottom and having an air inlet therein engagable by a finger of the user to totally close said side wall air inlet at will, a flow passage from said smoke outlet to said stem, and a portion of flow passage comprising a flow barrier between said air inlet means of the side wall and said smoke outlet.

2. The structure in claim 1, and the side wall and outer wall being connected by a closure at their upper edges above said air inlet means.

3. The structure in claim 2, and said closure being continuous and free of openings between the upper edges of the bowl portion and the outer wall.

4. The structure in claim 1, and said air inlet in said outer wall being disposed to provide a supply of ambient air from outside the bowl for flow upwardly between said side walls and said outer wall.

5. The structure in claim 4, and said outer wall comprising a ceramic material.

6. The structure in claim 1, and said side wall air inlet means comprising a plurality of openings extending downwardly from adjacent the top of the bowl portion to a vertically medial portion thereof.

7. The structure in claim 1, and said bowl button, other than said smoke outlet, being closed, and the smoke outlet being located approximately centrally of the bowl button.

8. The structure in claim 1, and a shell comprising an outer wall having side portions spaced about said side wall and a bottom portion spaced below the bottom of said bowl portion, and a socket for said bowl portion having releasable frictional engagement with said bowl portion to removably retain the bowl portion in the shell.

9. The structure in claim 8, and said socket being of silicone rubber and comprising said flow barrier between said air inlet means and said smoke outlet.

10. The structure in claim 9, and said pipe body having a stem extension, a smoke tube in said stem extension, and an end of said smoke tube being embedded in said silicone rubber and in flow communication with the smoke outlet in said bowl portion.

11. The structure in claim 8, and said outer wall comprising a ceramic material.

12. The structure in claim 1, and said pipe body outer wall being of ceramic material.

13. The structure in claim 1, and said side wall air inlet being vertically elongated and extending from the upper portion of the side wall downwardly to adjacent the vertical center of the bowl.

* * * * *